US006122867A

United States Patent [19]

Leconte

[11] Patent Number: 6,122,867

[45] Date of Patent: Sep. 26, 2000

[54] ACOUSTIC BUILDING STRUCTURE

[75] Inventor: Alain Leconte, Houilles, France

[73] Assignee: Isover Saint-Gobain, Courbevoie, France

[21] Appl. No.: 09/203,736

[22] Filed: Dec. 2, 1998

[30] Foreign Application Priority Data

Dec. 2, 1997 [FR] France ..... 97 15175
Mar. 5, 1998 [FR] France ..... 98 02678

[51] Int. Cl.[7] ..... E04B 1/82

[52] U.S. Cl. ..... 52/144; 52/406.3; 52/407.1; 52/404.4; 52/592.1; 52/592.6; 52/779; 52/794.1

[58] Field of Search ..... 52/144, 145, 479, 52/506.06, 794.1, 272, 779, 241, 406.3, 407.1, 404.4, 592.1, 592.6; 181/290, 285, 294

[56] References Cited

U.S. PATENT DOCUMENTS

| | | | |
|---|---|---|---|
| 2,077,713 | 4/1937 | Ross et al. | 52/145 |
| 2,200,650 | 5/1940 | Welch | 156/245 |
| 3,911,636 | 10/1975 | Larsson | 52/241 |
| 3,948,347 | 4/1976 | Rutledge | 181/33 G |
| 4,084,367 | 4/1978 | Saylor et al. | 428/113 |
| 4,685,259 | 8/1987 | Eberhart et al. | 52/144 |
| 4,838,524 | 6/1989 | McKeown et al. | 256/24 |
| 4,964,250 | 10/1990 | Nelson | 52/144 |
| 5,009,043 | 4/1991 | Kurrasch | 52/145 |
| 5,260,525 | 11/1993 | Morse | 181/285 |
| 5,392,572 | 2/1995 | Elmore et al. | 52/144 |
| 5,404,686 | 4/1995 | Esposito | 52/588.1 |
| 5,502,931 | 4/1996 | Munir | 52/144 |
| 5,661,273 | 8/1997 | Bergiadis | 181/290 |
| 5,713,161 | 2/1998 | Veldhoen | 52/144 |
| 5,787,651 | 8/1998 | Horn et al. | 52/144 |

*Primary Examiner*—Christopher T. Kent
*Assistant Examiner*—Jennifer I. Thissell
*Attorney, Agent, or Firm*—Oblon, Spivak, McClelland, Maier & Neustadt, P.C.

[57] ABSTRACT

In an acoustic building structure corresponding to the mass-spring-mass insulation principle, the two masses of the mass-spring-mass system are each formed of at least one rigid element (1,2) and are separated by at least one panel (4) of mineral wool combined with at least one air gap (5). The acoustic structure is such that the rigid elements (1,2) are trays with a U-shaped cross section and are lined on the inside of the U with at least one mineral wool (3).

17 Claims, 3 Drawing Sheets

ACOUSTIC BUILDING STRUCTURE

BACKGROUND OF THE INVENTION

1. Field of the Invention

The subject of the invention is an acoustic building structure corresponding to the mass-spring-mass insulation principle and comprising panels of mineral wool. The invention will be described more particularly for the case of an acoustic building partition but it is not limited to this particular type of acoustic building structure. Vertical linings, floors, and ceilings intended for acoustic insulation in various building also fall within the scope of the invention.

2. Discussion of the Background

Acoustic insulation or correction is commonly achieved in building using panels or rolls of mineral wool whose acoustic behavior is at the present time undeniably renowned for its good performance. Many mass-spring-mass systems satisfy the acoustic insulation or correction criteria; such systems are, for example, partitions consisting of panels of mineral wool which are positioned between at least two plasterboards or else vertical linings consisting of panels of mineral wool which are combined with at least one plasterboard and adhesively bonded or mechanically fixed to a masonry or concrete wall. There are very many variants of these systems, their performance depending on three parameters, namely surface density and nature of the walls, thickness and nature of the spring and thickness and nature of the damper.

At the present time, there is an increasing demand for systems with higher performance, whether in terms of acoustic insulation or in terms of acoustic correction, in particular in the non-dwelling sectors. This is because many industrial buildings and leisure complexes are being put up in urban areas and the acoustic regulations in force require, in the case of such buildings, that the general acoustic insulation be greater than 50 dB(A) for the insulation between the rooms themselves; the interior-to-exterior insulation of the room and the exterior-to-interior insulation of the room must also be greater than 50 dB(A).

However, added to this demand for increasingly high-performance systems is the need to produce acoustic systems using industrial components having excellent performance/cost ratio.

SUMMARY OF THE INVENTION

An object of the invention is to provide an acoustic building structure, corresponding to the mass-spring-mass insulation principle, which makes is possible to obtain a very high-performance insulation and which is quick and simple to install so as to reduce the overall cost of the system.

This and other objects are achieved by an acoustic building structure corresponding to the mass-spring-mass insulation principle, the two masses of the mass-spring-mass system each comprising at least one panel of mineral wool combined with at least one air gap. The structure is such that the rigid elements are trays with a U-shaped cross section and are lined on the inside of the U with at least one mineral wool. Preferably, the two masses of the system are mechanically fixed to building elements, advantageously the two masses of the system being placed on each side of the building framework elements.

In this way, the trays thus lined constitute the masses of the system, the surface density of which is controlled by the lining, and this lining adds, to the mass effect, the intrinsic properties of the acoustic behavior of the mineral wools. This combination of a tray and a mineral wool thus constitutes an effective acoustic cladding panel.

In addition, such rigid elements fixed to building elements, such as building frameworks elements, also serve as load-bearing frameworks. This is because, unlike partitions consisting of panels of mineral wool which are positioned between at least two plasterboards, with these boards constituting the masses of the system, it is unnecessary to use a metal frameworks in addition to the building framework in order to fix the masses of the system. In this way, the use of such rigid elements make it possible to dispense with this metal framework and thus it is simpler and quicker to install the masses of the system.

Advantageously, the acoustic damping coefficient of the structure is great than 50 dB(A) and preferably greater than 60 dB(A).

According to an advantageous embodiment of the invention, the ends of the flanges of the U of the trays have complementary shapes allowing the trays to fit together so that the bottoms of the trays form a continuous surface. In this way, it is possible to produce a large area while minimizing the points of attachment of the trays to the building elements; since the trays fit together, they may be mechanically fixed at one of their ends only.

According to a preferred variant of the invention, one of the ends is a simple fold towards the outside of the tray and the other end is profiled so as to received the folded end of another tray and to have flange which extends towards the outside of the tray parallel to the bottom of the tray. In this way, two trays fit together simply and quickly. Advantageously, the profiled end makes it possible, because of the flange, to fix the tray easily since access to this flange remains clear once the tray has been put into place. Moreover, this profiled end allows the lining of the tray to be positioned and held in place without any risk of damage. The part receiving the folded end of another tray provides positioning and retention at this part of the tray and, in the opposite part of the tray, the lining is held in place by the flange of the profiled end of the adjacent tray.

According to a variant of the invention, at least one of the trays is made of solid sheet metal. According to a second variant of the invention, at least one of the trays is made of perforated sheet metal, these perforations in the tray making it possible to benefit from the sound dissipating function of the mineral wool lining the tray. In this way, the structure is not only of high performance in terms of acoustic insulation but it is also of high performance in terms of acoustic correction, the latter having a good sound absorption coefficient.

According to a preferred embodiment of the invention, the trays are fixed to the building elements by means of a simple or acoustic spacer. These spacers advantageously make it possible to increase the thickness of the air gap of the mass-spring-mass system by increasing the separation between the two masses of the system. The acoustic spacers also allow the masses to be acoustically independent, thereby preventing the transmission of vibrations. Advantageously, the simple or acoustic spacer has an adjustable spacer length. In this way, the thickness of the air gap may be adjusted as required using a single type of spacer.

According to an advantageous variant of the invention, the trays are lined on the inside of the U with a high-density mineral wool such as, for example, rock wool. Rock wool, generally having a density higher than glass wool, makes it possible to increase the overall surface density of the tray in comparison with the use of a glass wool.

According to another variant of the invention, the trays are lined on the inside of the U with a low-density mineral wool, such as a glass wool, and with at least one additional load, such as a plasterboard, placed on the bottom of the tray or on the surface. In this way, the overall surface density of the tray is controlled by the addition of a high-density element.

According to a preferred embodiment of the invention, the bottom of the two trays faces the outside of the structure. In this way, the mineral wool lining the inside of the trays combines three fundamental acoustic functions. It increases the mass, it acts as a complementary damper and it allows the thickness of the air gap to be increased. The acoustic insulation performance of this type of construction is particularly good.

According to another embodiment of the invention, the bottom of the two trays faces the inside of the structure. In this way, the mineral wool combines two fundamental acoustic functions. It increases the mass and it acts as a dissipater. This type of construction is advantageous in the case of acoustic correction.

According to another possible embodiment of the invention, the bottom of one of the trays faces the outside of the structure, and the bottom of the second tray faces the inside of the structure. In this way, the fundamental acoustic functions described above depend on the orientation of the panels. This type of construction is particularly suitable for producing the shell of buildings.

According to an advantageous variant of the invention, the trays form the support for the cladding panels necessary for finishing off the acoustic structure such as, for example, plasterboards or cladding tiles. Such cladding panels may have a purely aesthetic function but must not impair the acoustic behavior of the mineral wool. This is because, when they act as a dissipater, the covering will, for example, be made of perforated sheet metal or of an absorbent material. Whatever the situation, the use of various cladding panels will generally depend on acoustic insulation criteria, acoustic correction criteria, aesthetic appearance criteria, fire resistance criteria, cost criteria, etc.

BRIEF DFSCRIPTION OF THF DRAWINGS

Further advantages and features will emerge below from the description of illustrative embodiments according to the invention with reference to the drawings, in which.

DETAILED DESCRIPTION OF THE PREFERRED EMBODIMENTS

The various acoustic structures shown consist of trays 1 and 2 which are lined with panels 3 of rock wool and are separated by panels 4 of glass wool which include an air gap 5. According to these illustrations, the trays 1 and 2 are made of galvanized solid sheet metal having a U-shaped cross section and a sheet metal thickness of 0.75 mm.

Figure 1:
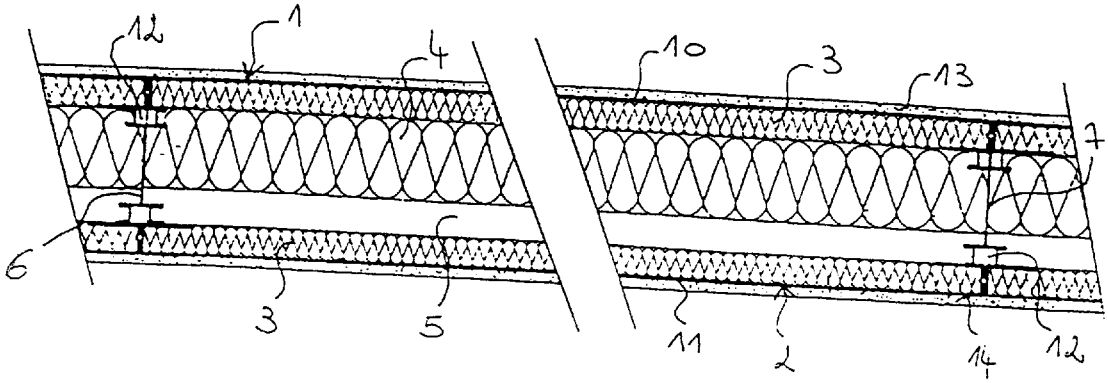
FIG. 1 is horizontal cross section of an acoustic structure according to the invention.
Figure 2:
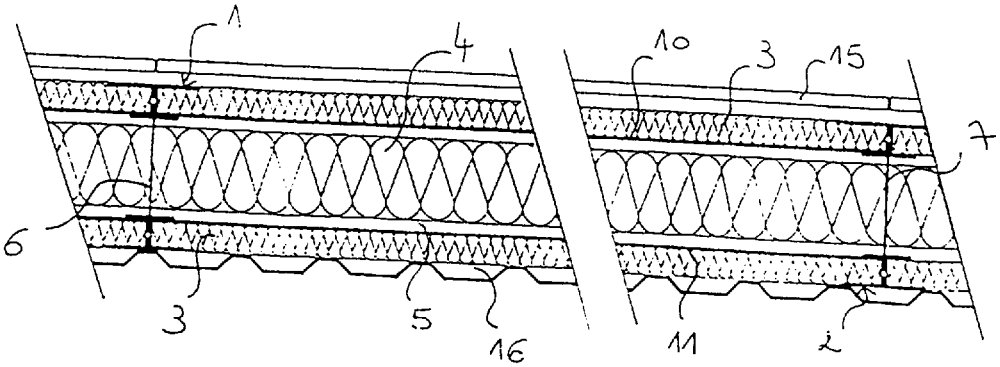
FIG. 2 is a horizontal cross section of another acoustic structure according to the invention.

The dimensions of the trays 1 and 2 are 70 mm in depth, 400 mm in height and from 3.25 to 8 m in length. This length will be tailored to the distance between the two building framework elements to which the panels 1 and 2 will be fixed. These building framework elements are shown in FIGS. 1 and 2 in the form of stanchions 6 and 7 of the metal structure. Advantageously, the trays 1 and 2 are joined together by their sides 8 and 9 fitting together. In this way, the height or width of the acoustic structure may be easily attained by positioning the trays 1 or 2 fitted together.

According to these illustrations, the side 9 has a tab 17 which is inserted into the profiled region 18 of the side 8 of an adjacent tray 1 or 2, the two trays 1 and 2 fitted together in this way having their bottoms 10 and 11 lying in the same plane. Advantageously, the flange 19 of the side 8 makes it possible to fix the trays 1 and 2 to the building elements by any means known to those skilled in the art such as, for example, by the use of a spacer. Such a type of tray 1 or 2 is advantageous for installing the panels 3 of rock wool: the edge of the panel 3 of rock wool is inserted between the profiled region 18 and the bottom 10 or 11 of the tray 1 or 2, and then the rest of the panel 3 is positioned on the bottom 10 or 11 of the tray 1 or 2. Once the tray 1 or 2 has thus been lined, this tray 1 or 2 is fitted into another tray 1 or 2 already in place, and the tray 1 or 2 is fixed to the building elements at the flange 19 already fixed to the building elements. In this way, the panel 3 of rock wool is held in place on one side by the profiled region 18 and on the other side by the flange 19 of the adjacent tray 1 or 2, which was already fixed to the building elements.

The panels 3 of rock wool are inserted into these trays 1 and 2, these panels 3 having a thickness of 70 mm and a density of approximately 110 kg/m$^3$.

After having fixed the trays 1 lined with the panels 3 of rock wool to the stanchions 6 and 7 of the building, the panels 4 of glass wool are positioned between the two stanchions 6 and 7 by any means known to those skilled in the art such as, for example, by means of a pinning device. The panels 4 of glass wool have a thickness of 120 to 200 mm and, on one face, have a simple or aluminum vapor barrier. Such panels 4 are, for example, of the type manufactured by Isover Saint-Gobain and sold under the name MONOSPACE 36. Once these panels 4 of glass wool are positioned, the trays 2 lined with the panels 3 of rock wool are fixed to the stanchions 6 and 7 of the building symmetrically with respect to the trays 1 already in place. The acoustic structures thus mounted correspond to the principle of mass-spring-mass insulation, the masses consisting of both trays 1 and 2 lined with the panels 3 of rock wool. Because of the presence of the trays 1 and 2 fixed to the stanchions 6 and 7, the erection of such structures is quickly carried out and in a simplified manner compared with the existing acoustic structures.

FIG. 1 illustrates an acoustic structure in which the bottoms 10 and 11 of the trays 1 and 2 face the outside of the structure. These trays 1 and 2 are fixed to the stanchions 6 and 7 of the building by means of acoustic separators 12. Such acoustic separators 12 are known to those skilled in the art, such as, for example, the anti-vibration devices sold by Paulstra. These acoustic spacers 12 allow the masses of the mass-spring-mass system to be made acoustically independent, thereby preventing the transmission of vibrations. The back of the trays 1 and 2 each receive plasterboards 13 and 14 as finishing panels. These plasterboards 13 and 14 are fixed directly to the trays 1 and 2, for example by screwing, these trays then also serving as cladding support. As we will see later, such an acoustic structure is particularly suitable as an insulating partition for a building.

FIG. 2 illustrates an acoustic structure in which the bottoms 10 and 11 of the trays 1 and 2 face the inside of the structure. These trays 1 and 2 are fixed directly to the stanchions 6 and 7 of the building by any means known to those skilled in the art, such as, for example, by screwing or nailing. The orientation of the trays 1 and 2 is such that the panels 3 of rock wool form the exterior faces of the acoustic structure. Consequently, a perforated metal sheet 15 is fixed, by any means known to those skilled in the art, to the visible edges of the trays 1, and an exterior troughed steel sheeting 16 is fixed by any means known to those skilled in the art to the visible edges of the trays 2. The perforated metal sheet 15 and the exterior troughed steel sheeting 16 are, for example, fixed simply by screwing. As we will see later, such an acoustic structure is particularly suitable as an absorbent acoustic partition for a building.

Figure 3:
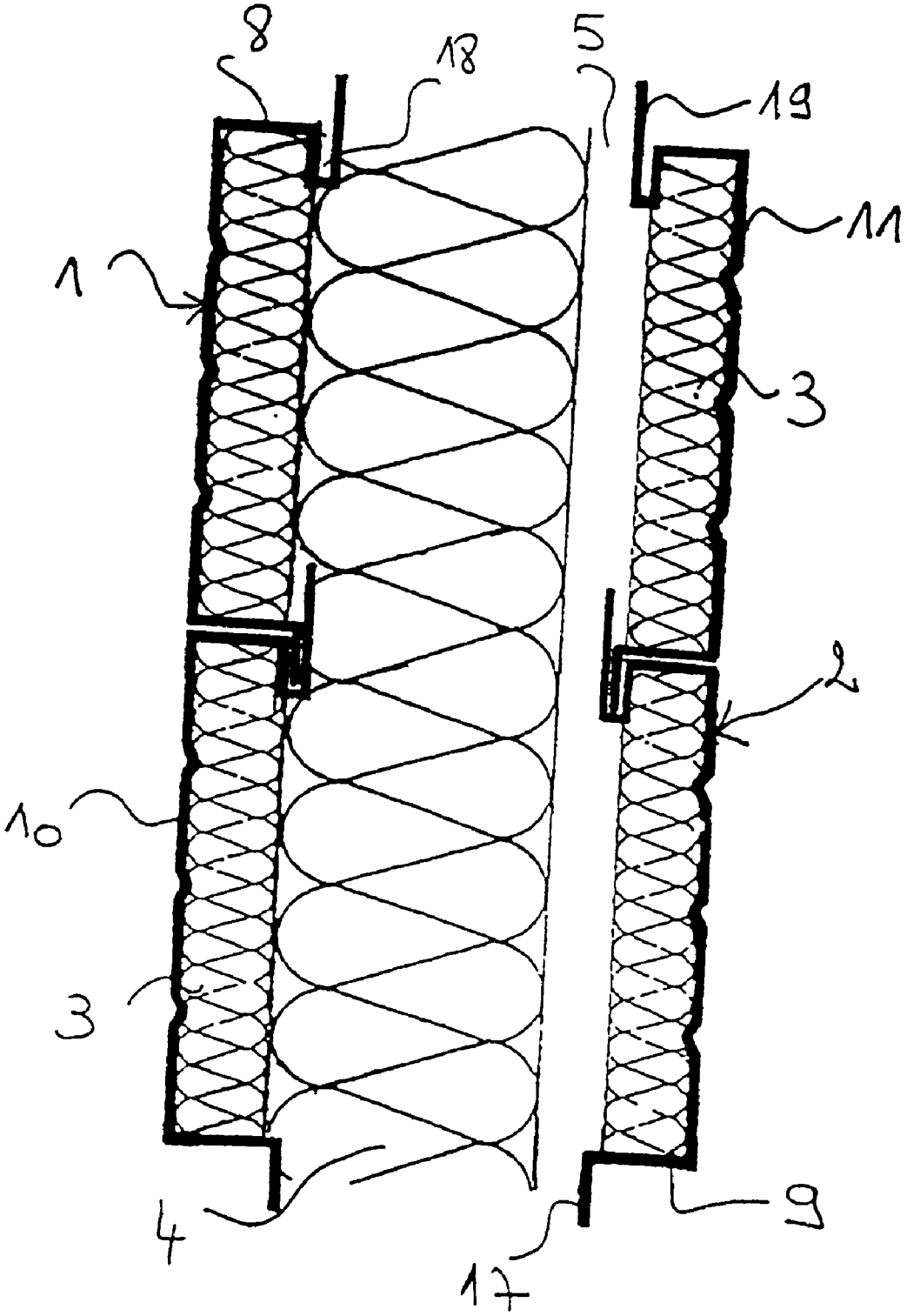
FIG. 3 is a vertical cross section of a first type of construction of an acoustic structure according to the invention.

FIG. 3 shows a vertical cross section of a first type of construction of an acoustic structure according to the invention. According to this illustration, the bottoms 10 and 11 of the trays 1 and 2 face the outside of the structure. In this type of construction, the rock wool lining the inside of the trays 1 and 2 combines three fundamental acoustic functions:

First, it increases the mass of the mass-spring-mass system. Thus, the use of the panels 3 of rock wool 70 mm in thickness and 170 kg/m$^3$ in density makes it possible to increase the 12 kg/m$^2$ surface density.

Second, it acts as a damper complementary to the damping already provided by the panels 4 of glass wool, the spring of the system already being damped to approximately 80% of the cavity by the glass wool.

Third, it allows the thickness of the air gap 5 to be increased. This is because the spring of the system involves the separation between the two masses of the system. This construction thus allows the thickness of the air gap 5 to be increased by approximately 50% of the thickness of the panels 3 of rock wool. This construction is therefore particularly advantageous for the production of insulating acoustic partitions.

Figure 4:
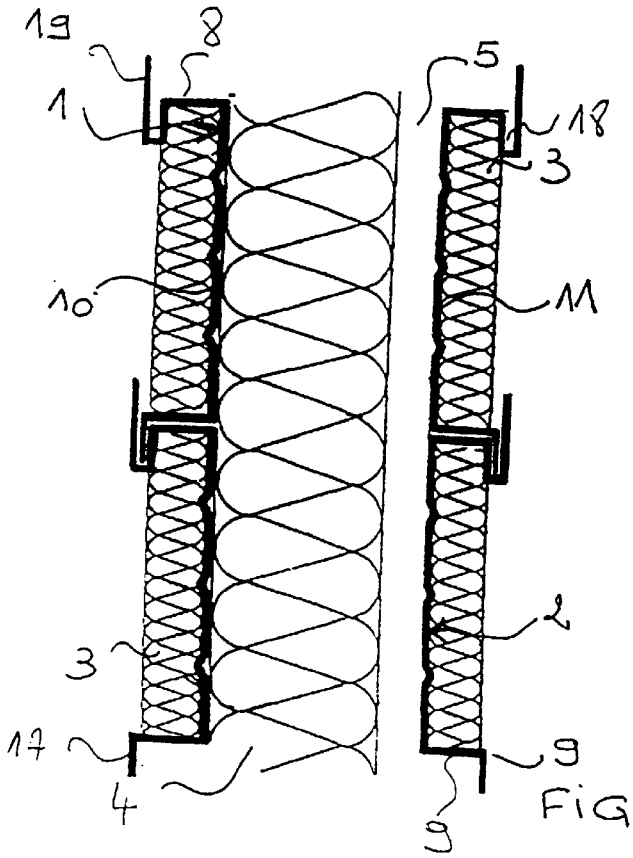
FIG. 4 is a vertical cross section of a second type of construction of an acoustic structure acceding to the invention.

FIG. 4 shows a vertical cross section of a second type of construction of an acoustic structure according to the invention. According to this illustration, the bottoms 10 and 11 of the trays 1 and 2 face the inside of the structure. In this type of construction, the rock wool lining the inside of the trays 1 and 2 combines two fundamental acoustic functions: First, as previously mentioned, it increase the masses of the mass-spring-mass system. Second, it acts as a dissipater with an external covering by a perforated metal sheet or by an absorbent material. This construction is therefore particularly advantageous for the production of insulating and absorbent acoustic structures.

Figure 5:
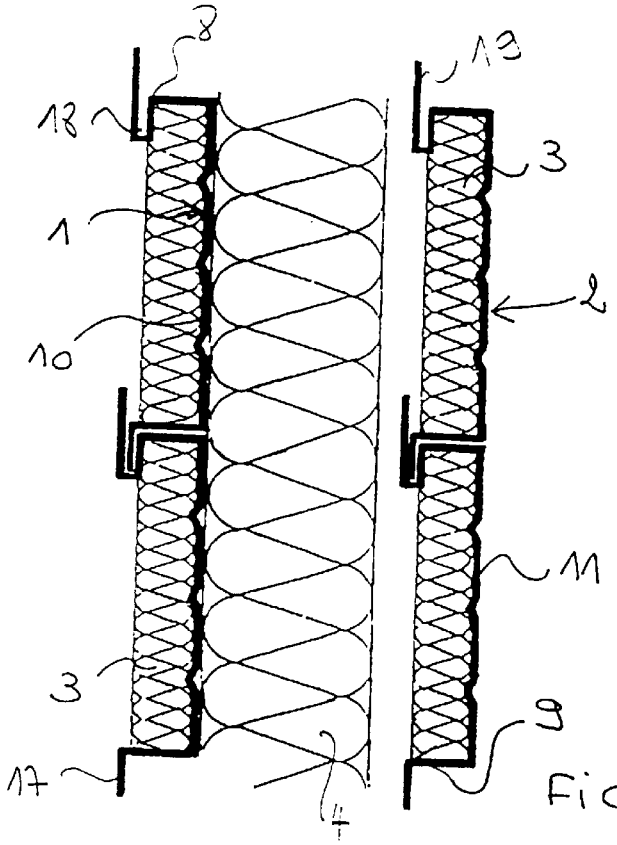
FIG. 5 is a vertical cross section of a third type of construction of an acoustic structure according to the invention.

FIG. 5 shows a vertical cross section of a third type of construction of an acoustic structure according to the invention. According to this illustration, the bottom 10 of the tray 1 faces the inside of the structure and the bottom 11 of tray 2 faces the outside of the structure. In this type of construction, the rock wool lining the trays 1 and 2 combines the various acoustic functions described in the above two first types of construction, depending on the orientation of the trays 1 and 2. This particularly advantageous construction makes it possible to obtain very high-performance acoustic insulation while still maintaining good acoustic correction on one side of the structure. This construction is particularly suitable for the production of building shells.

The table below gives the measurements of the acoustic damping coefficients for various building structures, these being in the following order:

No. 1) Two single trays separated from each other by a 420 mm air gap. The trays are the trays 1 and 2 of the various figures described above and are positioned in an identical manner to those in FIG. 3;

No. 2) Identical to No. 1, but the trays are lined with panels of glass wool having a thickness of 70 mm and a density of 12 kg/m$^3$;

No. 3) Identical to No. 1, but the trays are lined with panels of rock wool having a thickness of 75 mm and a density of 155 kg/m$^3$;

No. 4) Identical to No. 3, but the air gaps is decreased by inserting a panel of glass wool having a thickness of 160 mm and a density of 16 kg/m$^3$ between the two trays (this corresponds to FIG. 3);

No. 5) Identical to No. 4, but the trays are each covered on the outside with a plasterboard having a thickness of 18 mm and a surface density of 15 kg/m$^2$ (this corresponds to FIG. 1);

No. 6) Identical to No. 5, but replacing one plasterboard by a metal sheet having a thickness of 60 mm and a surface density of 5 kg/m$^2$;

No. 7) Identical to No. 4, but replacing one of the trays by a perforated tray and covering the other tray with the metal sheet of structure No. 6

| Structure No. | 1 | 2 | 3 | 4 | 5 | 6 | 7 |
|---|---|---|---|---|---|---|---|
| Damping coefficient $R_{ROSE}$ in dB(A) | 32 | 44 | 50 | 55 | 76 | 69 | 55 |

These acoustic damping coefficients were measured according to the NF S 31-049, S 31-050 and S 31-051 standards in an installation conforming to the standards on building structures having the dimensions 3.95×2.55 m$^2$.

This table clearly shows the indisputable acoustic performance of the acoustic building structures according to the invention, that is to say structures No. 4, 5, 6 and 7. In fact, the mass-spring-mass system according to this invention results in an acoustic damping coefficient of at least 55 dB(A) and, by improving the No. 4 base structure, it is possible to obtain an acoustic damping coefficient of 76 dB(A) which, at the current time, represents an excellent acoustic result.

The invention is not limited to the types of construction illustrated in the various figures. The trays 1 and 2 may advantageously be made of perforated galvanized sheet metal so as to benefit from the dissipater function of the rock wool lining the trays 1 and 2, in particular when the bottoms 10 and 11 of the trays 1 and 2 face the outside of the structure, it being possible for these trays to receive cladding panels such as plasterboards.

Moreover, the trays 1 and 2 may also be lined with panels of glass wool, the surface density of the trays 1 and 2 then being increased by adding an additional load on the bottom of the tray or on the surface. Such a load may, for example, be a plasterboard connected to the bottom of the tray by means of a mineral binder, for example of the adhesive plaster type.

The invention must be interpreted in a non-limiting manner and as encompassing any type of acoustic building structure corresponding to the mass-spring-mass system, each comprising at least one rigid element and being separated by at least one panel of mineral wool combined with at least one air gap, the rigid elements being trays having a U-shaped cross section and being lined on the inside of the U with at least one mineral wool.

What is claimed is:

1. An acoustic building structure, including serially arranged elements, as viewed in a direction of thickness of the structure, comprising:

a first mass comprising a combination of a tray with a U-shaped cross-section and mineral wool lined on an inside of the U-shape to constitute an acoustic panel;

at least one panel of mineral wool combined with at least one air gap; and a second mass comprising a combination of a tray with a U-shaped cross-section and mineral wool lined on an inside of the U-shape to constitute an acoustic panel, wherein said masses, said panel of mineral wool and said air gap are sized and configured to correspond to a mass-spring-mass system of acoustic insulation.

2. An acoustic building structure according to claim 1, wherein the two masses are mechanically fixed to building elements.

3. An acoustic building structure according to claim 2, wherein the two masses are positioned on each side of the building elements.

4. An acoustic building structure according to claim 1, wherein the structure is constructed such that the acoustic damping coefficient of the structure is greater than 60 dB(A).

5. An acoustic building structure according to claim 1, wherein flanges of the U-shape of the trays have complementary shapes allowing the trays to fit together such that bottoms of the U shape of the trays form a continuous surface.

6. An acoustic building structure according to claim 5, wherein one of the flanges of each tray has a simple fold towards an outside of the tray and that the other flange is profiled so as to receive the folded flange of another tray and also to extend towards the outside of the tray parallel to the bottom of the U shape of the tray.

7. An acoustic building structure according to claim 1, wherein at least one of the trays is made of solid sheet metal.

8. An acoustic building structure according to claim 1, wherein at least one of the trays is made of perforated sheet metal.

9. An acoustic building structure according to claim 1, wherein the trays are fixed to building elements by a spacer.

10. An acoustic building structure according to claim 9, wherein the spacer has an adjustable spacer length.

11. An acoustic building structure according to claim 1, wherein the trays are lined on the inside with a high-density mineral wool.

12. An acoustic building structure according to claims 1, wherein the trays are lined on the inside with a glass wool, and with a plasterboard.

13. An acoustic building structure according to claim 1, wherein the bottom of the U shape of the two trays faces an outside of the structure.

14. An acoustic building structure according to claim 1, wherein the bottom of the U shape of the two trays faces an inside of the structure.

15. An acoustic building structure according to claim 1, wherein a bottom of one of the two trays faces an outside of the structure, and a bottom of a second tray faces an inside of the structure.

16. An acoustic building structure according to claim 1, further comprising finishing panels supported by the trays.

17. Acoustic building structure according to claim 16, wherein the finishing panels are plasterboards.

* * * * *